US011819093B2

(12) United States Patent
Kim

(10) Patent No.: US 11,819,093 B2
(45) Date of Patent: Nov. 21, 2023

(54) AIRTIGHT TYPE ZIPPER

(71) Applicant: Young Gyo Kim, Busan (KR)

(72) Inventor: Young Gyo Kim, Busan (KR)

( * ) Notice: Subject to any disclaimer, the term of this patent is extended or adjusted under 35 U.S.C. 154(b) by 0 days.

(21) Appl. No.: 17/561,491

(22) Filed: Dec. 23, 2021

(65) Prior Publication Data

US 2023/0180898 A1 Jun. 15, 2023

(30) Foreign Application Priority Data

Dec. 9, 2021 (KR) ..... 10-2021-0176119

(51) Int. Cl.
*A44B 19/32* (2006.01)
*A44B 19/06* (2006.01)

(52) U.S. Cl.
CPC ..... *A44B 19/32* (2013.01); *A44B 19/06* (2013.01)

(58) Field of Classification Search
CPC ..... A44B 19/32; A44B 19/06
See application file for complete search history.

(56) References Cited

U.S. PATENT DOCUMENTS 2,229,216 A * 1/1941 Davis ..... A44B 19/26 24/382
3,490,109 A * 1/1970 Heimberger ..... A44B 19/32 24/389
3,892,016 A * 7/1975 Brown ..... A44B 19/32 24/389
4,817,252 A * 4/1989 Kusayama ..... A44B 19/32 24/384
4,841,603 A * 6/1989 Ragni ..... B65D 33/255 24/584.1
4,941,238 A * 7/1990 Clark ..... A44B 19/14 24/584.1
6,701,584 B2 * 3/2004 Metzger ..... A44B 19/265 24/426
9,125,459 B1 * 9/2015 Lin ..... A44B 19/02
9,545,134 B1 * 1/2017 Tan ..... A44B 19/262
9,896,241 B2 * 2/2018 Anzini ..... B65D 33/2508
10,016,026 B2 * 7/2018 Miyazaki ..... A44B 19/26
10,144,160 B2 * 12/2018 Cheng ..... B29C 45/00
10,362,839 B2 * 7/2019 Minato ..... A44B 19/10
11,464,298 B2 * 10/2022 Kim ..... A44B 19/08
(Continued)

FOREIGN PATENT DOCUMENTS

KR 20-0362028 Y1 9/2004

*Primary Examiner* — Jason W San
(74) *Attorney, Agent, or Firm* — The PL Law Group, PLLC

(57) ABSTRACT

An airtight type zipper according to an embodiment of the present disclosure includes a first zipper member in which first zipper protrusions and first zipper grooves are alternately and continuously formed and a second zipper member coupled to or separated from the first zipper member in a sliding manner, and includes a first closely joined rail formed to be protruded in a continuous direction of the first zipper protrusion and the first zipper grooves and a second closely joined rail formed to be protruded from the first closely joined rail in a shape corresponding to the first closely joined rail, and in which a first closely joined groove and a second closely joined groove, that are mutually coupled to the first closely joined rail and the second closely joined rail when coupled with the first zipper member, are formed in the second zipper member.

7 Claims, 5 Drawing Sheets

(56) References Cited

U.S. PATENT DOCUMENTS

| | | | | |
|---|---|---|---|---|
| 2003/0000049 | A1* | 1/2003 | Ichikawa | A44B 19/32<br>24/389 |
| 2004/0211041 | A1* | 10/2004 | Morioka | A44B 19/36<br>24/389 |
| 2008/0313863 | A1* | 12/2008 | Swain | A44B 19/32<br>24/30.5 R |
| 2009/0211852 | A1* | 8/2009 | Hannon | A44B 19/16<br>24/415 |
| 2010/0303390 | A1* | 12/2010 | Ackerman | B65D 33/255<br>383/63 |
| 2012/0311828 | A1* | 12/2012 | Nir | B29C 45/14573<br>24/389 |
| 2014/0366336 | A1* | 12/2014 | Chung | A44B 19/16<br>24/389 |
| 2015/0000087 | A1* | 1/2015 | Tanaka | A44B 19/32<br>24/389 |
| 2015/0157096 | A1* | 6/2015 | Mikuma | A44B 19/32<br>24/389 |
| 2016/0198812 | A1* | 7/2016 | Tan | A44B 19/22<br>24/389 |
| 2020/0008542 | A1* | 1/2020 | Kim | A44B 19/32 |
| 2020/0399762 | A1* | 12/2020 | Urita | C22C 21/06 |
| 2021/0378368 | A1* | 12/2021 | Metani | A44B 19/36 |
| 2022/0079302 | A1* | 3/2022 | Kim | B65B 61/18 |

* cited by examiner

AIRTIGHT TYPE ZIPPER

CROSS-REFERENCE TO RELATED APPLICATION(S)

This application claims the benefit under 35 USC § 119(a) of Korean patent Application No. 10-2021-0176119, filed on Dec. 9, 2021, in the Korean Intellectual Property Office, the entire disclosure of which is incorporated herein by reference for all purposes.

BACKGROUND

Technical Field

Embodiments of the present disclosure relate to an airtight type zipper for airtight maintenance of a container storing a fluid.

Background Art

Generally, the airtight type zipper is a zipper provided in a container so that airtightness of the liquid content or gaseous content is maintained and the liquid content or gaseous content is stored in the container (structure that can maintain a stored state of the contents).

In particular, in the case of storing gas, it is important to maintain airtightness, and thus the airtight type zipper had a disadvantage in that it was rather difficult to make gas flow into or out from the container. In the case of extracting gas from the container, the gas had to be exhausted in a reverse direction through the structure into which the gas has flowed. In the case of a structure where it is important to maintain airtightness, the structure is mainly configured to facilitate the inflow of gas, but in the case of outflow, it is formed to enable the outflow of gas through a cumbersome process.

In the case of employing a zipper to compensate for this point, a gas outflow process is simplified, but it may be difficult to maintain airtightness when the zipper is fastened. That is, coupling force capable of withstanding air pressure is also required for the zipper. Therefore, ease in exhausting air again after injecting air into the container and fastening force of the zipper for maintaining a sealed state when air is in the container are required.

SUMMARY

Embodiments of the present disclosure are to provide an airtight type zipper with excellent fastening force by being able to maintain a stronger coupling state.

The embodiments of the present disclosure are to provide an airtight type zipper capable of increasing sealing force due to excellence in airtightness maintenance.

According to an embodiment of the present disclosure, there is provided an airtight type zipper which includes a first zipper member in which first zipper protrusions and first zipper grooves are alternately and continuously formed and a second zipper member coupled to or separated from the first zipper member in a sliding manner, and includes a first closely joined rail formed to be protruded in a continuous direction of the first zipper protrusion and the first zipper grooves and a second closely joined rail formed to be protruded from the first closely joined rail in a shape corresponding to the first closely joined rail, and in which a first closely joined groove and a second closely joined groove, that are mutually coupled to the first closely joined rail and the second closely joined rail when coupled with the first zipper member, are formed in the second zipper member.

The second closely joined rail may be formed in a plural number on the first closely joined rail, and thus the sealing force of the airtight type zipper may be further improved.

The first closely joined rail and the second closely joined rail may be formed to have a hardness range of 90~100 based on Shore A, which is a shore hardness tester. In this case, the first closely joined rail is preferably formed to have a greater hardness than the second closely joined rail.

The first closely joined rail and the second closely joined rail may be formed of, but are not limited to, resin or silicone, and various types of materials such as thermoplastic resin or rubber may be applied thereto.

The first closely joined rail may be formed of a hard material, and the second closely joined rail may be formed of a soft material.

Meanwhile, the airtight type zipper according to an embodiment of the present disclosure may be configured to include a slider for coupling or separating the first zipper member to and from the second zipper member in a sliding manner.

Here, a stopper may be provided at one ends of the first zipper member and the second zipper member to prevent the slider from being separated to the outside.

The airtight type zipper according to an embodiment of the present disclosure may be configured to include a frame provided inside at least one of the first closely joined rail and the second closely joined rail to increase a rigidity of the rail.

According to embodiments of the present disclosure, there is an advantage of being able to do.

And, according to embodiments of the present invention, there is an advantage of being able to do.

DETAILED DESCRIPTION

Hereinafter, a specific embodiment of the present disclosure will be described with reference to the drawings. The following detailed description is provided to aid in a comprehensive understanding of the methods, apparatuses and/or systems described herein. However, this is illustrative only, and the disclosed embodiments are not limited thereto.

In describing the embodiments, when it is determined that a detailed description of related known technologies may unnecessarily obscure the gist of disclosed embodiments, a detailed description thereof will be omitted. In addition, terms to be described later are terms defined in consideration of functions in the disclosed embodiments, which may vary according to the intention or custom of users or operators. Therefore, the definition should be made based on the contents throughout this specification. The terms used in the detailed description are only for describing embodiments, and should not be limiting. Unless explicitly used otherwise, expressions in the singular form include the meaning of the plural form. In this description, expressions such as "comprising" or "including" are intended to refer to certain features, numbers, steps, actions, elements, some or combination thereof, and it is not to be construed to exclude the presence or possibility of one or more other features, numbers, steps, actions, elements, some or combinations thereof, other than those described.

Figure 1:
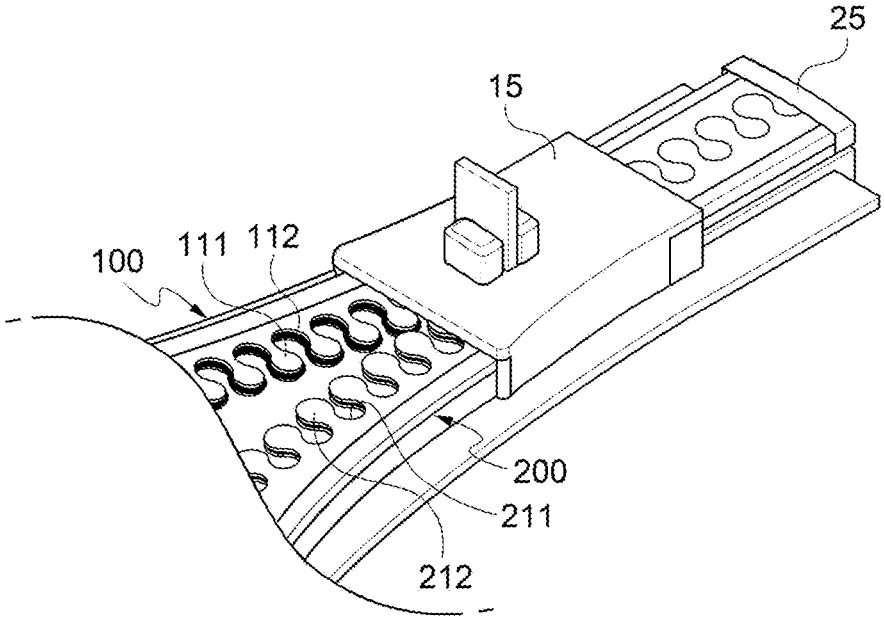
FIG. 1 is a perspective view schematically illustrating an airtight type zipper according to a first embodiment of the present disclosure.
Figure 2:
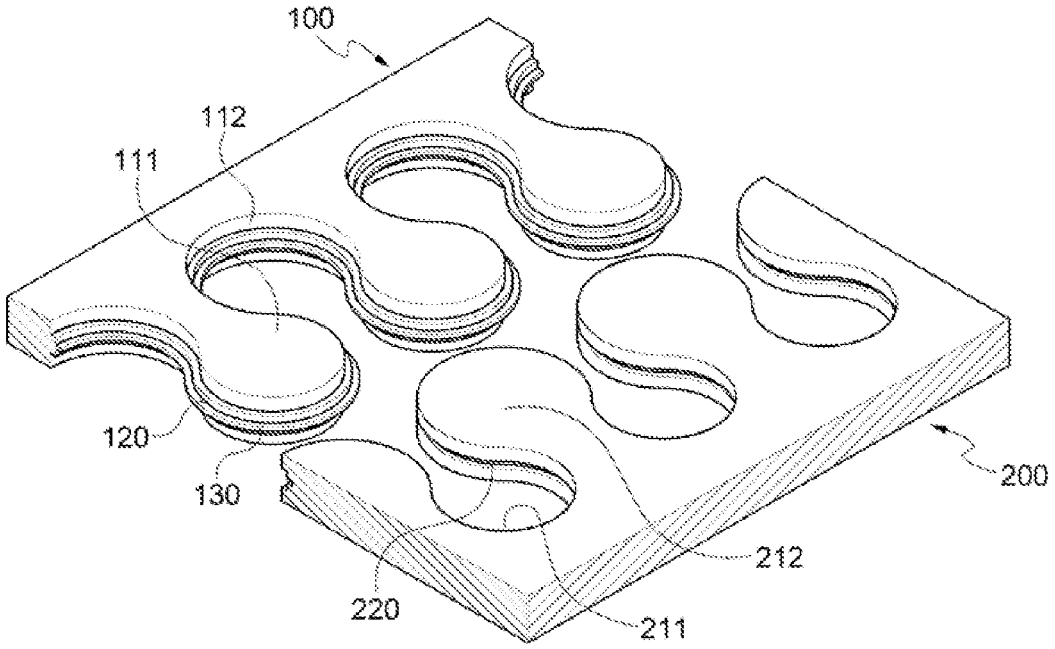
FIG. 2 is an enlarged perspective view of a main part of the airtight type zipper of FIG. 1.
Figure 3:
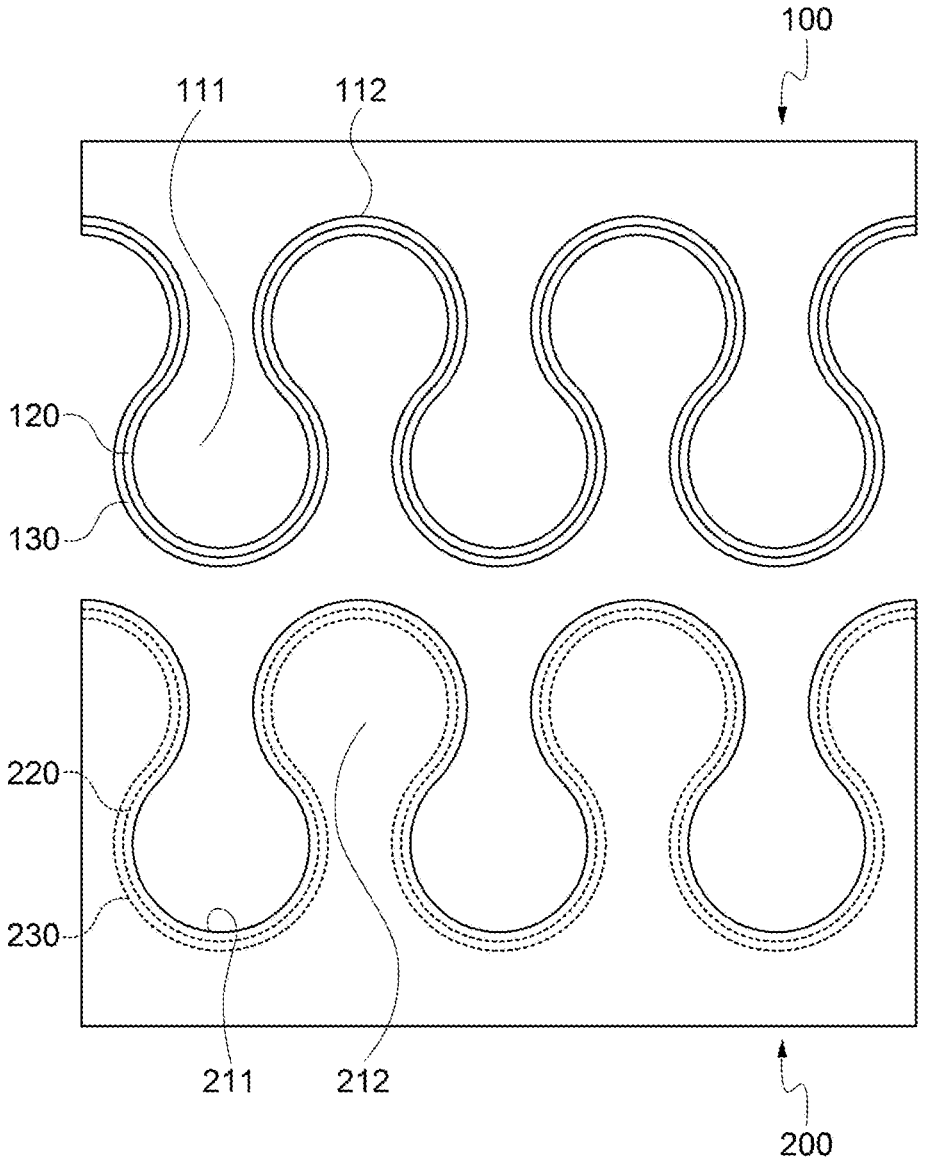
FIG. 3 is an enlarged plan view illustrating the main part of the airtight type zipper of FIG. 1.
Figure 4:
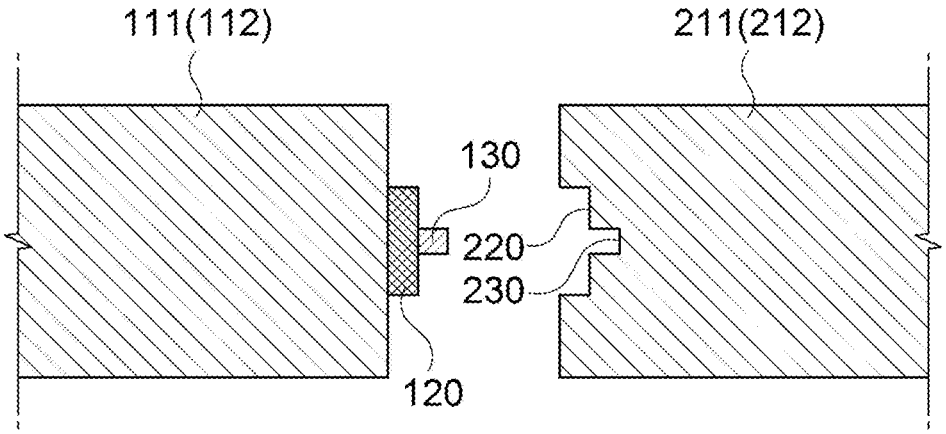
FIG. 4 is an enlarged cross-sectional view of the main part of the airtight type zipper of FIG. 1.

FIG. 1 is a perspective view schematically illustrating an airtight type zipper according to a first embodiment of the present disclosure, FIG. 2 is an enlarged perspective view of a main part of the airtight type zipper of FIG. 1, FIG. 3 is an enlarged plan view illustrating the main part of the airtight type zipper of FIG. 1, and FIG. 4 is an enlarged cross-sectional view of the main part of the airtight type zipper of FIG. 1.

Referring to FIGS. 1 to 4, the airtight type zipper according to the first embodiment of the present disclosure may be configured to include a first zipper member 100 in which first zipper protrusions 111 and first zipper grooves 112 are alternately and continuously formed and a second zipper member 200 coupled to or separated from the first zipper member 100 in a sliding manner.

More specifically, the first zipper member 100 may include a first closely joined rail 120 formed to be protruded in a continuous direction of the first zipper protrusions 111 and the first zipper grooves 112 and a second closely joined rail 130 formed to be protruded from the first closely joined rail 120 in a shape corresponding to the first closely joined rail 120.

In addition, the second zipper member 200 may include second zipper protrusions 212 and second zipper grooves 211 that correspond to the first zipper grooves 112 and the first zipper protrusions 111, and a first closely joined groove 220 coupled to the first closely joined rail 120 and a second closely joined groove 230 coupled to the second closely joined rail 120 when the first zipper member 100 and the second zipper member 200 may be formed in the second zipper grooves 211 and the second zipper protrusions 212.

Accordingly, when the first zipper member 100 and the second zipper member 200 are coupled, the first zipper protrusions 111 and the second zipper grooves 211 are engaged with each other, the first zipper grooves 112 and the second zipper protrusions 212 are engaged with each other, and at the same time, the first closely joined rail 120 is coupled to the first closely joined groove 220, and the second closely joined rail 130 is coupled to the second closely joined rail 130, and thus, in the airtight type zipper of this embodiment, fastening force between the first zipper member 100 and the second zipper member 200 is maximized by a three-stage coupling structure, thereby capable of firmly maintaining the coupling state of the airtight type zipper and providing excellent sealing force.

Here, the first closely joined rail 120 and the second closely joined rail 130 may be formed to have a hardness range of 90-100 based on Shore A, which is a shore hardness tester. In addition, the first closely joined rail 120 and the second closely joined rail 130 may be formed of a material such as resin or silicone having the above hardness range, but is not limited thereto, and may be formed of various types of thermoplastic resin or rubber, etc. In this case, the first closely joined rail 120 and the second closely joined rail 130 may be integrally formed when formed of the same material, and may be separately manufactured and coupled to each other or integrally formed by a double molding method when formed of different materials. In addition, the first closely joined groove 220 and the second closely joined groove 230 of the second zipper member 200 may be formed in a hardness range greater than that of the first closely joined rail 120 and the second closely joined rail 130, and thus, when the first zipper member 100 and the second zipper member 200 are coupled, the first closely joined groove 220 and the second closely joined groove 230 may support the first closely joined rail 120 and the second closely joined rail 130 while more firmly and closely joining the first and second closely joined rails.

Meanwhile, in this embodiment, the first closely joined rail 120 may be formed to have a greater hardness range than that of the second closely joined rail 130. In particular, the first closely joined rail 120 may be formed of a hard material, and the second closely joined rail 130 may be formed of a soft material. Accordingly, when the first zipper member 100 and the second zipper member 200 are coupled, the second contact rail 130 of the hard material is elastically compressed into the second closely joined groove 230 in a state where the first contact rail 120 of the hard material is closely supported on the first closely joined groove 220, thereby capable of increasing airtightness to further increase the sealing force of the airtight type zipper.

On the other hand, the airtight type zipper according to the first embodiment of the present disclosure may be configured to include a slider 15 (see FIG. 1) for coupling or separating the first zipper member 100 to or from the second zipper member 200 in a sliding manner. In this case, guide grooves may be formed on each edge of the first zipper member 100 and the second zipper member 200 in the longitudinal direction, and guide protrusions coupled to the guide grooves may be formed on both edges of the slider 15. Accordingly, the slider 15 may couple the first zipper member 100 and the second zipper member 200 in an interlocking manner or separate them in a mutually open manner while moving along the longitudinal direction of the first zipper member 100 and the second zipper member 200 in a sliding manner in a state where the guide protrusions are engaged with the guide grooves.

In addition, a stopper 25 may be provided at one ends of the first zipper member 100 and the second zipper member 200 to prevent the slider 15 from being separated to the outside while moving in the sliding manner. Here, the stopper 25 may prevent the slider 15 from being separated to the outside, and serve to couple and fix one ends of the first zipper member 100 and the second zipper member 200. In addition, the stopper 25 may be additionally provided to couple and fix the other ends of the first zipper member 100 and the second zipper member 200, or may be additionally provided at the other end of the first zipper member 100 and the other end of the second zipper member 200 to prevent only the separation of the slider to the outside.

Figure 5:
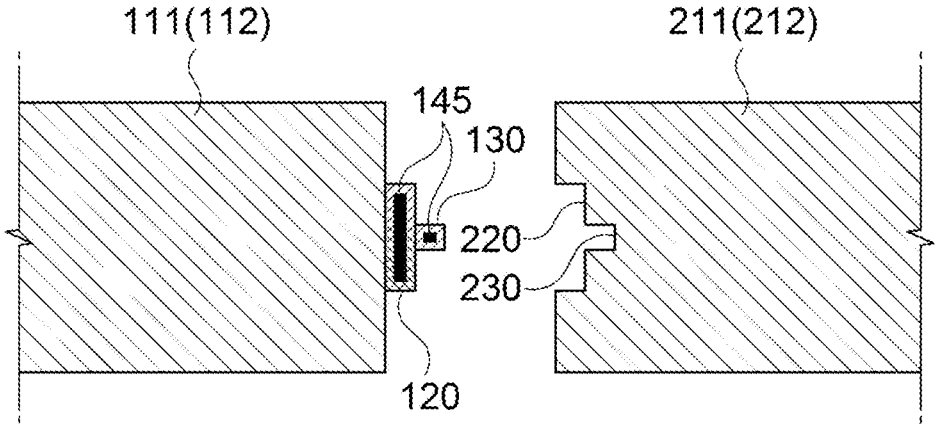
FIG. 5 is a cross-sectional view schematically illustrating a structure in which a frame is embedded in a first closely joined rail and a second closely joined rail of FIG. 4.

Meanwhile, FIG. 5 is a cross-sectional view schematically illustrating a structure in which a frame is embedded in the first closely joined rail and second closely joined rail of FIG. 4, and as illustrated in FIG. 5, a frame 145 for increasing the rigidity of the rail may be provided inside the first closely joined rail 120 and the second closely joined rail 130. Of course, the frame 145 may be embedded in only one of the first closely joined rail 120 and the second closely joined rail 130. As a result, the rigidity of the first closely joined rail 120 and the second closely joined rail 130 is increased by the frame 145, and thus it is possible to provide a stable sealing force by maintaining a more firmly coupled state when the first zipper member 100 and the second zipper member 200 are fastened. In particular, it is possible to provide a robust coupling force even to an external force applied in the longitudinal direction of the sealing zipper, that is, in the sliding direction of the slider 15.

Figure 6:
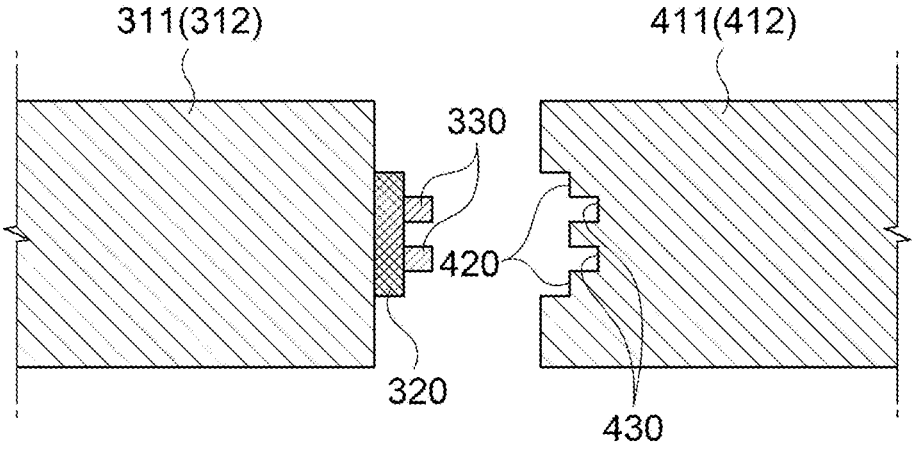
FIG. 6 is a cross-sectional view schematically illustrating an airtight type zipper according to a second embodiment of the present disclosure.

FIG. 6 is a cross-sectional view schematically illustrating an airtight type zipper according to a second embodiment of the present disclosure.

Referring to FIG. 6, unlike the first embodiment described above, the airtight type zipper according to the second embodiment of the present disclosure may be provided with a first closely joined rail 320 along the continuous direction of first zipper protrusions 311 and first zipper grooves 312 of the first zipper member, and a plurality of second closely joined rails 330 may be provided on the first closely joined rail 320 to be spaced apart from each other. In addition, in the second zipper member coupled to or separated from the first zipper member in a sliding manner, second zipper grooves 411 and second zipper protrusions 412 interlocking with the first zipper protrusions 311 and the first zipper grooves 312 may be provided. A first closely joined groove 420 coupled to the first closely joined rail 320 and a plurality of second closely joined grooves 430 coupled to the second closely joined rails 330 may be provided along a continuous direction of the second zipper grooves 411 and the second zipper protrusions 412. Accordingly, in this embodiment, the fastening force and sealing force of the airtight type zipper can be increased compared to the first embodiment described above through a double closely-joining structure of the second closely joined rails 330.

In this case, the first closely joined rail 320 provided with the second closely joined rails 330 may be provided in a plural number along a direction approximately perpendicular to the sliding direction of the airtight type zipper, and accordingly, the airtight type zipper of this embodiment may have a multiple sealing-and-locking structure according to the number of the first contact rails 320.

Meanwhile, in the airtight type zipper of this embodiment, in addition to the double closely-joining structure of the second closely joined rails 330, the hardness, material, frame, etc. of the first closely joined rail and the second closely joined rail may be applied similarly to the first embodiment described above, and thus a detailed description thereof will be omitted.

Figure 7:
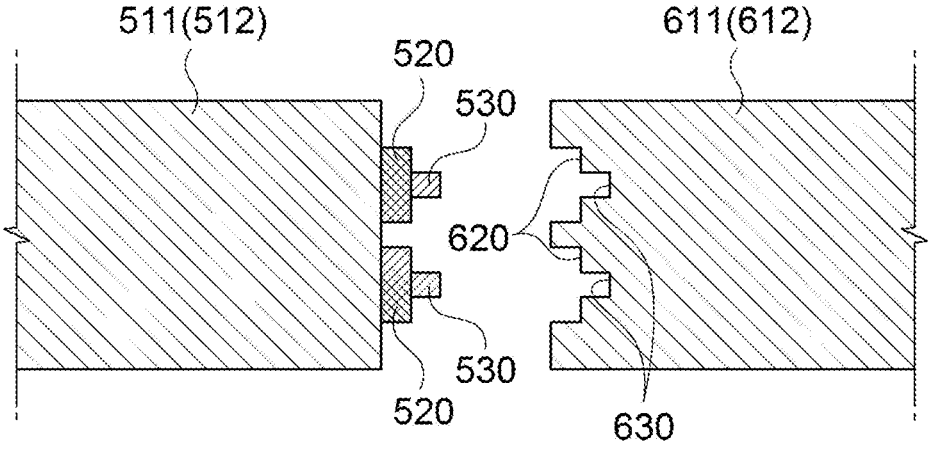
FIG. 7 is a cross-sectional view schematically illustrating an airtight type zipper according to a third embodiment of the present disclosure.

FIG. 7 is a cross-sectional view schematically illustrating an airtight type zipper according to a third embodiment of the present disclosure.

Referring to FIG. 7, the airtight type zipper according to the third embodiment of the present disclosure, similar to the first embodiment described above, a first closely joined rail 520 is provided along the continuous direction of first zipper protrusions 511 and first zipper grooves 512 of the first zipper member, and a second closely joined rail 530 may be provided on the first closely joined contact rail 520. In addition, the second zipper member coupled to or separated from the first zipper member in a sliding manner may be provided with second zipper grooves 611 and second zipper protrusions 612 interlocking with the first zipper protrusions 511 and the first zipper grooves 512 are provided, and a first closely joined groove 620 coupled to the first closely joined rail 520 and a second closely joined groove 630 coupled to the second closely joined rail 530 may be provided along a continuous direction of the second zipper grooves 611 and the second zipper protrusions 612.

However, unlike the first embodiment described above, the airtight type zipper of this embodiment may be provided with the three-stage coupling structure of the first zipper protrusions 511 and the second zipper grooves 611, the first closely joined rail 520 and the first closely joined groove 620, and the second closely joined rail 530 and the second closely joined groove 630 along a direction perpendicular to the sliding direction of the airtight type zipper in duplicate.

Accordingly, in this embodiment, since the three-stage coupling structure of the first embodiment is applied in duplicate, the fastening force and sealing force of the airtight type zipper can be further increased than that of the first embodiment described above. In particular, this embodiment may provide stronger coupling force to an external force applied in a direction perpendicular to the sliding direction of the airtight type zipper.

Of course, the airtight type zipper of this embodiment may be provided with the first closely joined rail 520 provided with the second closely joined rail 530 in triple or more along a direction approximately perpendicular to the sliding direction of the closed zipper, and thus may have a triple or more sealing-and-locking structure.

Meanwhile, in the airtight type zipper of this embodiment, in addition to the structure described above, the hardness, material, frame, etc. of the first closely joined rail and the second closely joined rail may be applied similarly to the first embodiment described above, and thus a detailed description thereof will be omitted.

Although representative embodiments of the present disclosure have been described in detail, those skilled in the art to which the present disclosure pertains will understand that various modifications may be made thereto within the limit without departing from the scope of the present disclosure. Therefore, the scope of rights of the present disclosure should not be limited to the described embodiments, but should be defined not only by claims set forth below but also by equivalents to the claims.

What is claimed is:

1. An airtight type zipper comprising:

a first zipper member in which first zipper protrusions and first zipper grooves are alternately and continuously formed; and a second zipper member coupled to or separated from the first zipper member in a sliding manner;

a first closely joined rail formed to be protruded from the first zipper protrusions and the first zipper grooves along a continuous direction of the first zipper protrusion and the first zipper grooves and a second closely joined rail formed to be protruded from the first closely joined rail in a shape corresponding to the first closely joined rail; and a first closely joined groove and a second closely joined groove being mutually coupled to the first closely joined rail and the second closely joined rail when coupled with the first zipper member, wherein the first closely joined groove and the second closely joined groove are formed along a continuous direction of the second zipper protrusion and the second zipper grooves of the second zipper member.

2. The airtight type zipper according to claim 1, wherein the second closely joined rail is formed in a plural number on the first closely joined rail.

3. The airtight type zipper according to claim 1, wherein the first closely joined rail and the second closely joined rail are formed of resin or silicone.

4. The airtight type zipper according to claim 1, wherein the first closely joined rail is formed of a hard material, and the second closely joined rail is formed of a soft material.

5. The airtight type zipper according to claim 1, further comprising:

a slider for coupling or separating the first zipper member to and from the second zipper member in a sliding manner.

6. The airtight type zipper according to claim 5, further comprising:

a stopper provided at one ends of the first zipper member and the second zipper member to prevent the slider from being separated to the outside.

7. The airtight type zipper according to claim 1, further comprising:

a frame provided inside at least one of the first closely joined rail and the second closely joined rail to increase rigidity of the rail.

* * * * *